US009065170B2

(12) United States Patent
Lee et al.

(10) Patent No.: US 9,065,170 B2
(45) Date of Patent: Jun. 23, 2015

(54) COMMUNICATION DEVICE COMPRISING AN EXTERNAL CONTROL WITH AN EMBEDDED ANTENNA ASSEMBLY

(71) Applicant: HARRIS CORPORATION, Melbourne, FL (US)

(72) Inventors: Myung Lee, Penfield, NY (US); Mark Benoit, Rochester, NY (US); Richard Furness, Kent, NY (US); Wojciech Mysliwiec, Rochester, NY (US)

(73) Assignee: Harris Corporation, Melbourne, FL (US)

( * ) Notice: Subject to any disclaimer, the term of this patent is extended or adjusted under 35 U.S.C. 154(b) by 137 days.

(21) Appl. No.: 13/644,729

(22) Filed: Oct. 4, 2012

(65) Prior Publication Data

US 2014/0099990 A1 Apr. 10, 2014

(51) Int. Cl.

| | |
|---|---|
| ***H01Q 1/24*** | (2006.01) |
| ***H01Q 1/08*** | (2006.01) |
| ***H01Q 1/12*** | (2006.01) |

(52) U.S. Cl.

CPC ..... *H01Q 1/088* (2013.01); *Y10T 29/49018* (2015.01); *H01Q 1/1207* (2013.01); *H01Q 1/243* (2013.01); *H01Q 1/244* (2013.01)

(58) Field of Classification Search

CPC ..... H01Q 1/243; H01Q 1/1207; H01Q 1/22; H01Q 1/088; H01Q 1/244; H01Q 1/24; H01Q 1/40; H01Q 1/42

USPC ..... 343/702, 720, 906, 873; 455/575.7, 455/344, 347

See application file for complete search history.

(56) References Cited

U.S. PATENT DOCUMENTS

| | | | | |
|---|---|---|---|---|
| 5,177,492 | A | 1/1993 | Tomura et al. | |
| 5,276,454 | A | 1/1994 | Gonzalez et al. | |
| 5,426,440 | A | 6/1995 | Shimada et al. | |
| 6,660,947 | B1 * | 12/2003 | Badescu | 200/4 |
| 6,753,818 | B2 | 6/2004 | Wang | |
| 7,116,937 | B2 * | 10/2006 | Kinzler | 455/41.2 |
| 7,253,778 | B1 | 8/2007 | Bingle et al. | |
| 7,994,987 | B2 * | 8/2011 | Berezin et al. | 343/702 |
| 2004/0027297 | A1 | 2/2004 | Chang | |
| 2005/0179613 | A1 | 8/2005 | Minoura | |

OTHER PUBLICATIONS

Information about Related Patents and Patent Applications, see section 6 of the accompanying Information Disclosure Statement Letter, which concerns Related Patents and Patent Applications.

International Search Report and Written Opinion mailed Nov. 25, 2013 in International Application No. PCT/US2013/063256.

* cited by examiner

*Primary Examiner* — Michael C Wimer

(74) *Attorney, Agent, or Firm* — Robert J. Sacco, Esq.; Fox Rothschild LLP

(57) ABSTRACT

Systems (300) and methods (900) for packaging an antenna (702) in a communication device (300). The methods involve coupling the antenna to a Printed Circuit Board ("PCB") such that the antenna is mechanically supported thereby. A hollow shaft (510) of a control knob (304) is positioned over the antenna and at least a portion of PCB (706) such that the antenna is embedded within the control knob. Thereafter, the control knob is mechanically secured to a housing (308) of the communication device. The control knob is arranged such that it can move in a radial direction and a vertical direction (516) relative to the chassis. The control knob is also arranged such that the hollow shaft is able to move freely over the antenna without coming in contact therewith.

23 Claims, 7 Drawing Sheets

COMMUNICATION DEVICE COMPRISING AN EXTERNAL CONTROL WITH AN EMBEDDED ANTENNA ASSEMBLY

BACKGROUND OF THE INVENTION

1. Statement of the Technical Field

The invention concerns communication devices. More particularly, the invention concerns communication devices having an external control with an embedded antenna.

2. Description of the Related Art

The top panel of a communication device (e.g., a portable radio) is very valuable for the reasons of accessibility and advantageous antenna positioning. Most communication devices have a primary antenna, a secondary antenna, external controls and a display screen. The external components often include buttons, knobs, antenna connectors, cable connectors and a keypad. At least some of the components of the external control are disposed on the top panel of the communication device. Similarly, the antennas have conventionally been disposed on the top panel of the communication device so as to protrude out and away therefrom. For example, FIG. 1 shows an exemplary communication device 100 which includes a control knob 102, a primary antenna 106 and a secondary antenna 104. Each of these components is disposed on a top panel 108 of the communication device.

However, there is great demand for small and unobtrusive communication devices. This demand has pushed some manufacturers to relocate the antennas from the outside of the chassis to the inside the chassis. While this improves the form factor of the communication devices, chassis-embedded antennas suffer degraded performance and higher susceptibility to surrounding electronics, board material, and human hands. Embedding the antennas also requires that the chassis be made out of non-metallic material, thus resulting compromised ElectroMagnetic Interference ("EMI") and structural ruggedness. For this reason, very few high performance communication devices have chassis-embedded antennas. Instead, most high performance communication devices have antennas protruding out and away from the top panel of the chassis, as described above. In order to keep up with the demand for communication devices with smaller form factor and less intrusive antennas, there needs to be a way to optimize the top panels of the communication devices.

SUMMARY OF THE INVENTION

Embodiments of the invention concern systems and methods for packaging an antenna in a communication device. The methods involve coupling an antenna to a printed circuit board such that the antenna is mechanically supported thereby. A hollow shaft of a control knob is positioned over the antenna and at least a portion of the printed circuit board such that the antenna is embedded within the control knob. Thereafter, the control knob is mechanically secured to a housing of the communication device. The control knob is arranged such that it can move in a radial direction and a vertical direction relative to the housing. The control knob is also arranged such that the hollow shaft is able to move freely over the antenna without coming in contact therewith. A watertight seal may be provided between the control knob and the housing. A resilient member may be provided for returning the control knob to a rest position after being depressed. A switch may be disposed adjacent to an end of the hollow shaft such that the hollow shaft can actuate the switch in response to a radial movement and/or vertical movement of the control knob.

BRIEF DESCRIPTION OF THE DRAWINGS

Embodiments will be described with reference to the following drawing figures, in which like numerals represent like items throughout the figures, and in which.

DETAILED DESCRIPTION

Figure 2:
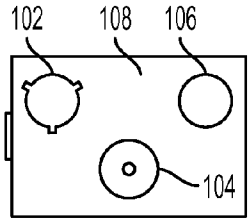
FIG. 2 PRIOR ART
FIG. 2 is a top view of the conventional communication device shown in FIG. 1.
Figure 1:
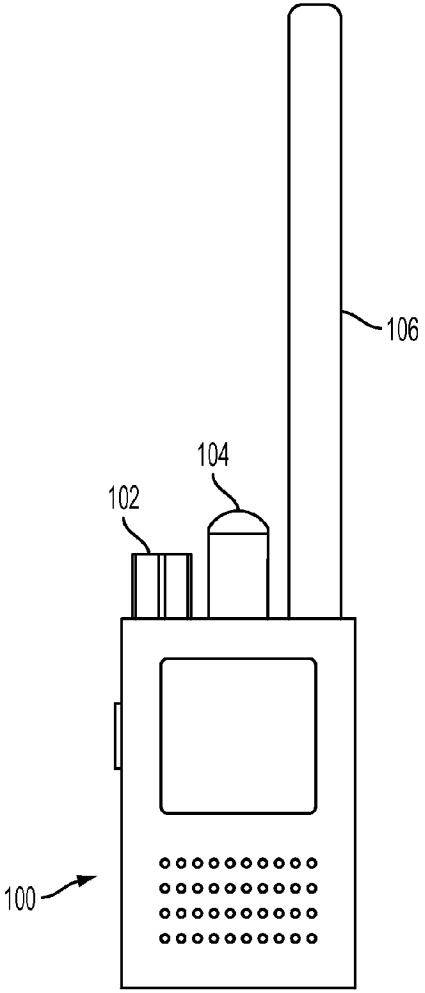
FIG. 1 PRIOR ART
FIG. 1 is a front view of a conventional communication device.

It will be readily understood that the components of the embodiments as generally described herein and illustrated in the appended figures could be arranged and designed in a wide variety of different configurations. Thus, the following more detailed description of various embodiments, as represented in the figures, is not intended to limit the scope of the present disclosure, but is merely representative of various embodiments. While the various aspects of the embodiments are presented in drawings, the drawings are not necessarily drawn to scale unless specifically indicated.

The present invention may be embodied in other specific forms without departing from its spirit or essential characteristics. The described embodiments are to be considered in all respects only as illustrative and not restrictive. The scope of the invention is, therefore, indicated by the appended claims rather than by this detailed description. All changes which come within the meaning and range of equivalency of the claims are to be embraced within their scope.

Reference throughout this specification to features, advantages, or similar language does not imply that all of the features and advantages that may be realized with the present invention should be or are in any single embodiment of the invention. Rather, language referring to the features and advantages is understood to mean that a specific feature, advantage, or characteristic described in connection with an embodiment is included in at least one embodiment of the present invention. Thus, discussions of the features and advantages, and similar language, throughout the specification may, but do not necessarily, refer to the same embodiment.

Furthermore, the described features, advantages and characteristics of the invention may be combined in any suitable manner in one or more embodiments. One skilled in the relevant art will recognize, in light of the description herein, that the invention can be practiced without one or more of the specific features or advantages of a particular embodiment. In other instances, additional features and advantages may be recognized in certain embodiments that may not be present in all embodiments of the invention.

Reference throughout this specification to "one embodiment", "an embodiment", or similar language means that a particular feature, structure, or characteristic described in connection with the indicated embodiment is included in at least one embodiment of the present invention. Thus, the phrases "in one embodiment", "in an embodiment", and similar language throughout this specification may, but do not necessarily, all refer to the same embodiment.

Embodiments of the present invention will now be described with respect to FIGS. 3-8. Embodiments of the present invention generally relate to systems and methods for freeing up valuable space on a top panel of a communication device. The reclaimed space of the top panel allows: the form factor of the communication device to be decreased; and/or the disposition of additional external controls on said top panel. Such additional external controls include, but are not limited to, a relatively small display screen, a connector, a Light Emitting Diode ("LED"), a button, and/or a knob. The reclaimed space is obtained by embedding a secondary antenna inside a control knob disposed on the top panel of the communication device. By embedding the secondary antenna in the control knob, the secondary antenna capability is concealed without paying a performance penalty. In some embodiments, the secondary antenna is a Global Positioning System ("GPS") antenna or a Global Navigation Satellite System ("GNSS") antenna. GPS and GNSS antennas are well known in the art, and therefore will not be described herein.

Figure 4:
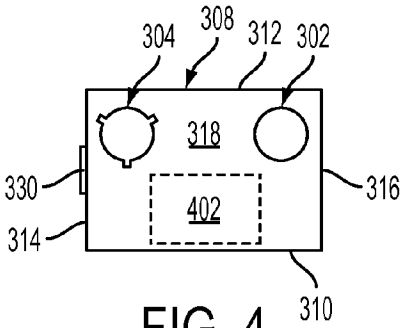
FIG. 4 is a top view of the exemplary communication device shown in FIG. 3.
Figure 3:
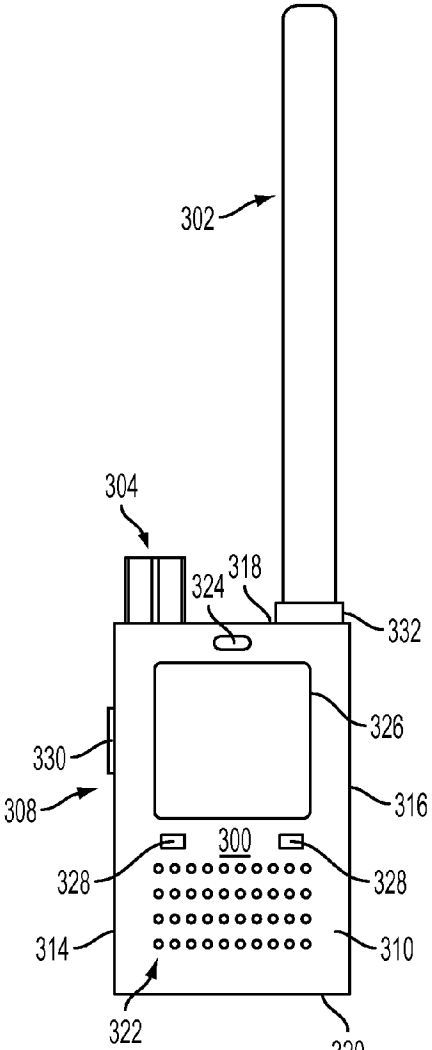
FIG. 3 is a front view of an exemplary communication device that is useful for understanding the present invention.

Referring now to FIGS. 3 and 4, there provided a front and a top view, respectively, of an exemplary communication device 300 that is useful for understanding the present invention. Although the communication device 300 is shown in FIGS. 3 and 4 to be a portable land mobile (LMR) radio, the invention is not limited in this regard. For example, the communication device 300 can be a mobile telephone, a cellular telephone, an MP3 player, a personal computer, a PDA, a game pad, a GPS device or any other electronic device capable of communicating with other remotely located communication devices. A common configuration for a communication device includes a housing 308 which is generally in the form of a rectangular prism. For example, many land mobile radio (LMR) devices have this basic configuration which includes several major surfaces. The surfaces generally include opposing front and back panels 310, 312, opposing top and bottom panels 318, 320, and opposing first and second side panels 314, 316 which extend between the front and back panels. The front and back panels are generally the largest of the major panels comprising the housing of the communication device. Conversely, the top and bottom panels are usually the smallest of the major surfaces.

The front panel 310 is conventionally arranged to facilitate convenient and effective operation of the communication device when the back panel 312 rests within the palm of a user's hand. As such, the front panel commonly includes a speaker grille 322 to accommodate output audio from a speaker disposed within the housing subjacent to the grille. The speaker grille facilitates listening to communications received by the communication device. A microphone port 324 can also reside at the front panel so that audio information (speech) originating with the user is effectively provided to a microphone within the housing. The front panel can also include an electronic display unit 326 which is intended to facilitate the presentation of information to a user concerning the operational status of the communication device. The position of the display unit on the front panel is advantageous because the front panel is generally unobstructed and within the user's line of sight when the back panel of the unit rests within the palm of a user's hand. In some communication devices, one or more control keys 328 are also provided on the front panel to facilitate control of various communication device functions. A push-to-talk (PTT) button 330 is commonly provided on a side panel 314 of the device.

The top panel 318 of the communication device extends from an upper peripheral edge of the front panel to an upper peripheral edge of the back panel. The top panel also extends between an upper peripheral edge of the first and second side panels 314, 316. As such, the top panel is generally transverse to the front, back and side panels. From a design perspective, the top panel is considered to be of particular importance. One reason for its importance is that a rotary control knob 304 extending from the top panel is easily accessed and manipulated by a user when the communication device resides in a holster secured to the user's body. In many conventional communication devices, the top panel serves as a preferred mounting location for one or more antennas utilized by the communication device.

The communication device 300 includes a primary antenna 302, and a secondary antenna (not shown in FIGS. 3 and 4). The primary antenna 302 includes, but is not limited to, a Radio Frequency ("RF") antenna. The secondary antenna includes, but is not limited to, a GPS antenna or a GNSS antenna. The communication device can further include, but is not limited to, a cable connector (not shown), an emergency button (not shown), and an LED (not shown). Notably, the rotary control knob 304 and antenna 302 is located on a top panel 318 of the communication device 300. This location ensures that the antenna 302 will extend out and away from a user's body when the device is held in the user's hand; and allows access to the control knob when the communication device 300 is being worn by the user (e.g., when the communication device 300 is disposed in a holster or mounted on a belt).

Significantly, the secondary antenna (not shown in FIGS. 3 and 4) is embedded within the rotary control knob 304. Accordingly, the secondary antenna is also disposed at the top panel. The manner in which the secondary antenna is embedded within the rotary control knob 304 will become evident as the discussion progresses. As a result of the secondary antenna embedment within control knob 304, valuable space 402 on a top panel 318 of a communication device 300 is reclaimed. The reclaimed space 402 allows: the form factor of the communication device 300 to be decreased; and/or the disposition of additional external controls on the top panel 318. Such additional external controls include, but are not limited to, a relatively small display screen, a connector, an LED, a button, and/or a knob.

The housing 308 is configured to house various internal components, including a battery which serves as a primary source of power for the communication device. The internal components also include, but are not limited to, internal circuitry for communicating signals to and from remotely located devices via the primary antenna 302 and/or the secondary antenna. More particularly, the internal components can comprise a receiver and/or a transmitter, which may in combination be configured as a transceiver. In this regard, the internal circuitry is electrically connected to an antenna connector to which the primary antenna 302 is coupled. The internal circuitry is also electrically connected to the secondary antenna, rotary control knob 304 and other external controls (e.g., a display screen, buttons, light emitting diodes, and/or a cable connector) of the communication device 300. Such electrical connections facilitate the user control of operations of the communication device 300.

Housing 308 can be formed from any conductive or non-conductive material. Such conductive materials include, but are not limited to, metal materials and composite materials. Such non-conductive materials include, but are not limited to, rubbers and plastics. In some embodiments, the housing material is selected to withstand high temperatures and/or harsh environmental conditions such that the internal components of the communication device 300 are protected from damage due to external factors. Similarly, the control knob 304, and the top panel 318 can be formed at least partially of a material that can withstand high temperatures and/or harsh environmental conditions. In addition, control knob 304 is made of a material that will not degrade performance of the secondary antenna (not shown) significantly. In this regard, the control knob 304 should have little or no metal content so as to prevent any negative impact on antenna performance or antenna radiation pattern. In some embodiments, control knob 304 is made entirely out of a plastic so that it has very little or no effect on antenna performance. The plastic includes, but is not limited to, an Acrylonitrile Butadiene Styrene ("ABS") plastic.

The housing 308 has a plurality of apertures formed therethrough. At least two of the apertures are formed through the top panel 318 of the electronic device 300. A control shaft for the control knob 304 is disposed at least partially in a respective one of the apertures formed through the top panel 318. Similarly, an antenna connector 332 is disposed at least partially in a respective one of the apertures formed through the top panel 318. The primary antenna 302 is coupled to the communication device 300 via the antenna connector 332.

Figure 5:
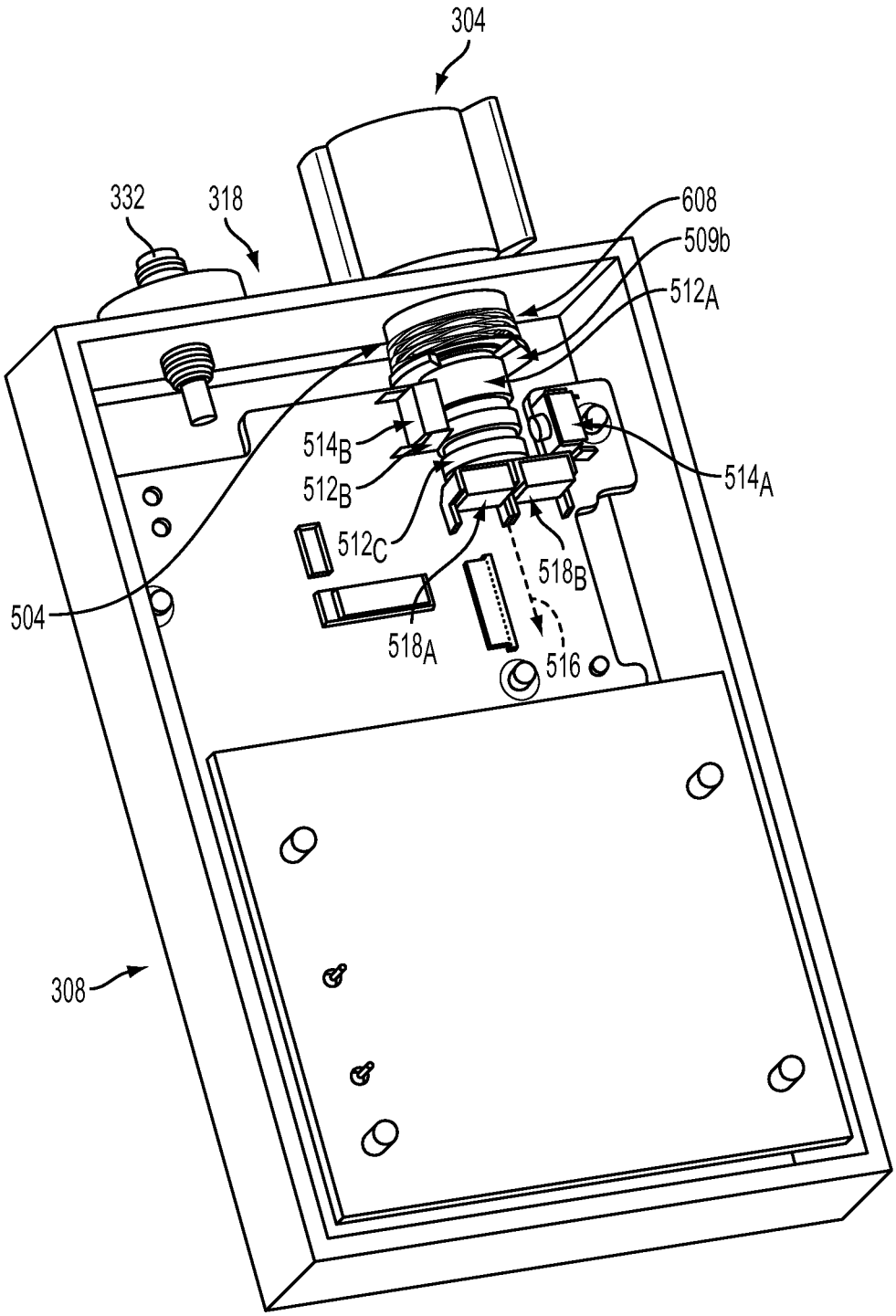
FIG. 5 is a perspective view of internal components of the communication device shown in FIGS. 3-4.

Referring now to FIG. 5, there is provided a perspective view of the internal components of the communication device 300 described above. A partial cut away view of selected internal components associated with control knob 304 is provided in FIG. 6. As may be observed in FIGS. 5 and 6, the control knob 304 is mechanically coupled to a top panel 318 of the housing 308 such that it can rotate and move vertically relative to the housing 308. The manner in which the control knob 304 is coupled to the housing 308 will become more evident as the discussion progresses.

Figure 6:
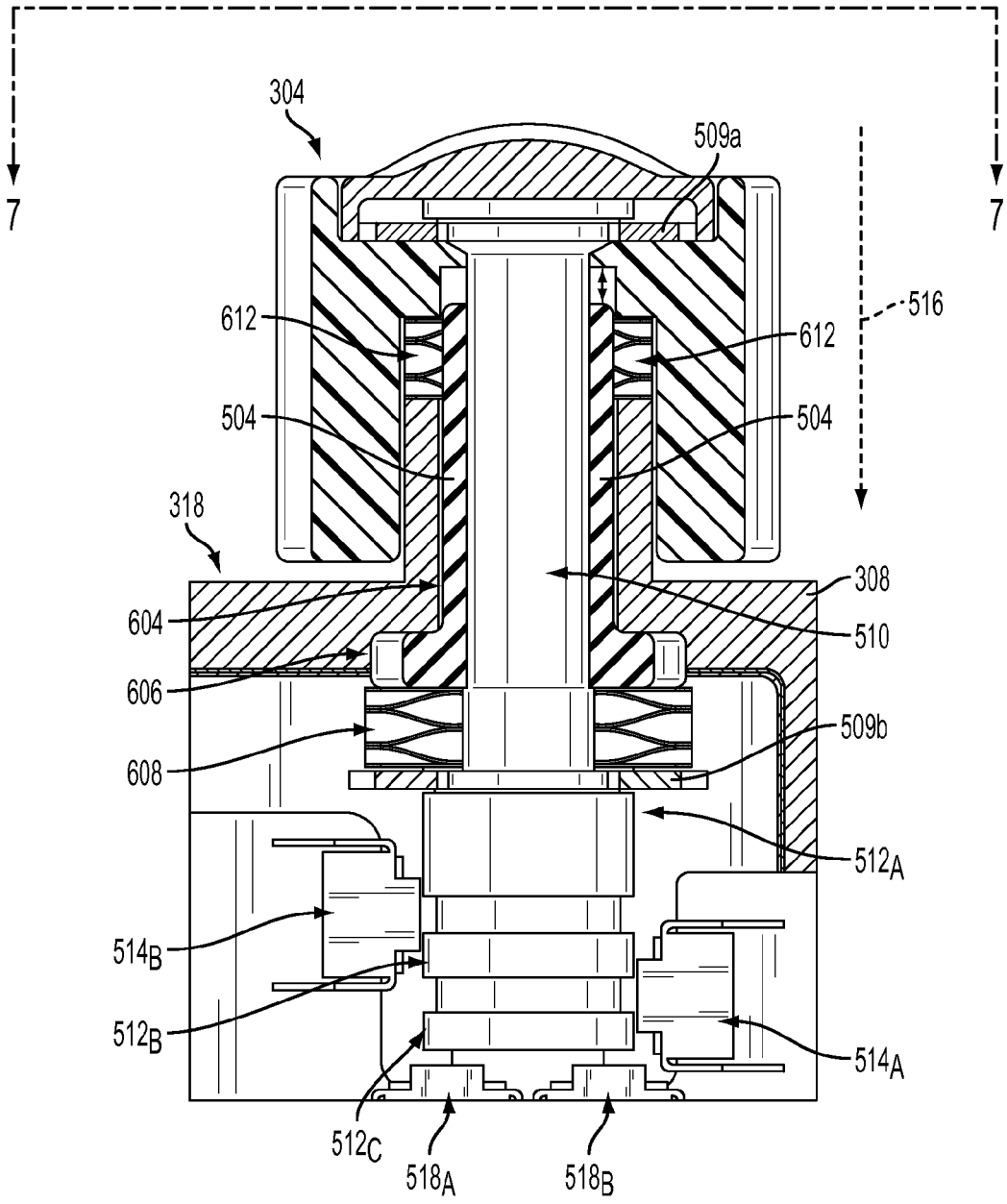
FIG. 6 is a cut away portion of the internal components shown in FIG. 5.

As shown in FIGS. 5-6, a gasket 504 is provided for creating a watertight seal between a shaft 510 of the control knob 304 and a top panel 318 of the housing 308. In this regard, the gasket 504 is advantageously formed of a compressible material, such as rubber or silicone. At least a portion of the gasket 504 and shaft 510 pass through an aperture 604 formed through the top panel 318 of the housing. The shaft 510 is resiliently captured within the aperture 604 by means of retention clips 509*a*, 509*b* and resilient members 608, 612. Resilient members 608, 612 are preferably springs, and more particularly wave springs. Still, the invention is not limited in this regard and other types of resilient members can be used for this purpose. The gasket 504 is mechanically coupled to the top panel via flanges 606 such that it can not move relative to the aperture 604 when the control knob 304 is being rotated and/or depressed by a user. A lubricant can be disposed between the gasket and the shaft 510 such that the shaft 510 can rotate freely without friction. Also, in some embodiments, an adhesive may be disposed between the gasket 504 and the aperture 604 to ensure that the gasket 504 is securely attached to the housing 308.

The control knob 304 is rotatably coupled to the housing 308. As such, the control knob 304 can be rotated by a user thereof so as to select one of a plurality of operational modes (e.g., different frequency or volume). The shaft 510 is attached to the control knob 304 so that it rotates when the control knob 304 rotates. The shaft 510 comprises a plurality of radial protrusions $\mathbf{512}_A$, $\mathbf{512}_B$, $\mathbf{512}_C$ configured to depress switches $\mathbf{514}_A$, $\mathbf{514}_B$ when the shaft is in its respective radial positions. The depression of each switch $\mathbf{514}_A$, $\mathbf{514}_B$ signifies user selection of a particular one of the plurality of operational modes.

The control knob 304 is also configured to be depressed by a user in a vertical direction 516 towards the interior of the housing 308. When the user depresses the control knob 304, the shaft 510 also moves in the vertical direction 516, while gasket 504 remains fixed in position relative to the housing. As a consequence of the vertical movement of components 304, 510, actuators associated with switches 518A, 518B are depressed by shaft 510. The depression of the actuators can be used to signal a user selection of a particular one of the plurality of operational modes. Although two switches 518A, 518B are shown in FIG. 5, embodiments of the present invention are not limited in this regard. For example, any number of switches 518A, 518B can be provided. Also, the shaft 510 can be designed such that one or more of the switches 518A, 518B is depressed in response to a radial movement and/or vertical movement of the control knob 304. In such embodiments, the shaft 510 would include additional protrusions (not shown) extending out and away from an end of the shaft towards the interior of the housing 308 as indicated by arrow 516.

The resilient member 612 is advantageously provided for purposes of ensuring that the control knob 304 returns to its rest position after a user releases the knob. Resilient member 608 is used to pre-load the resilient member 612 and to help resiliently capture the shaft 510 within the aperture 604. Although FIGS. 5-6 show two resilient members disposed adjacent to the gasket 504, embodiments of the present invention are not limited in this regard.

Figure 7:
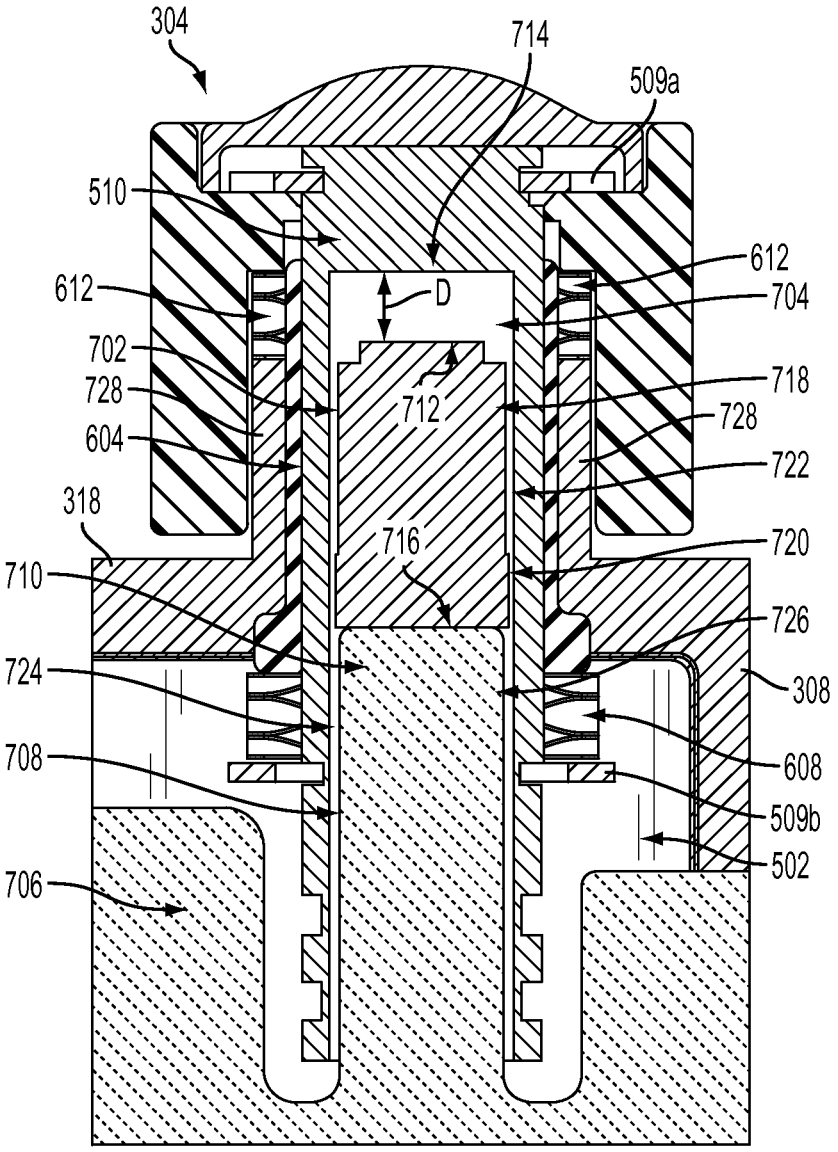
FIG. 7 is a cross sectional view of a cut away portion of the internal components taken along line 7-7 of FIG. 6.

Referring now to FIG. 7, there is provided a cross sectional view of a portion of the internal components taken along line 7-7 of FIG. 6. As shown in FIG. 7, an antenna 702 is disposed within an interior cavity 704 of hollow shaft 510. By including the antenna 702 in internal cavity 704, the antenna capability is concealed. Notably, the control knob 304 is designed such that it will not interfere with antenna performance or antenna radiation pattern. In this regard, the control knob 304 is at least partially formed of a low loss material, such as a plastic. Similarly, the resilient members 608, 612 can be formed of a low loss material, such as ABS plastic. The inclusion of antenna 702 within control knob 304 also allows for a reduction in the form factor of communication device 300 and/or for the provision of additional external controls on a top panel of the communication device 300.

Notably, the arrangement of antenna 702 in FIG. 7 is such that at least a portion of the antenna is actually disposed within a part of the housing defined by aperture wall 728. In such embodiments, at least a portion of the aperture wall adjacent to antenna 702 is preferably formed of a low RF loss material, such as ABS plastic. Alternatively, the circuit board 706 and/or housing structure which defines aperture 604 can be arranged so that all or most of the antenna 702 fully extends outside the aperture wall 728.

The antenna 702 is electrically connected to internal circuitry of the communication device 300 via a Printed Circuit Board ("PCB") 706. The antenna 702 is also mechanically supported by the PCB 706 such that it is held in place thereby. In this regard, the antenna 702 is coupled to the PCB 706 such that its bottom surface 716 is adjacent to an end 710 of the PCB 706. A portion 708 of the PCB 706 at least partially extends into the interior cavity 704 of hollow shaft 510.

Notably, the antenna 702 and PCB portion 708 are coupled to the housing 308 such that they do not move radially when the control knob 304 is rotated by a user and/or move vertically when the control knob 304 is depressed by the user. In this regard, the antenna 702 is located in the interior cavity 704 such that a distance D exists between a top surface 712 of the antenna 702 and an end surface 714 of the interior cavity 704 when the control knob 304 is in its rest position, as shown in FIG. 7. Such an antenna arrangement, ensures that the shaft 510 will not displace or otherwise damage the antenna 702 when the knob 304 is depressed by a user.

Similarly, a clearance space 722 is advantageously provided between a sidewall 718 of antenna 702 and a sidewall 720 of the interior cavity 704. Clearance space 722 is also provided between sidewalls 724, 726 of PCB portion 708 and sidewall 720 of the interior cavity 704. The provision of clearance space 722 ensures that the shaft 510 will not come in contact with the antenna 702 and PCB portion 708 when it is rotated by a user thereof.

Figure 8:
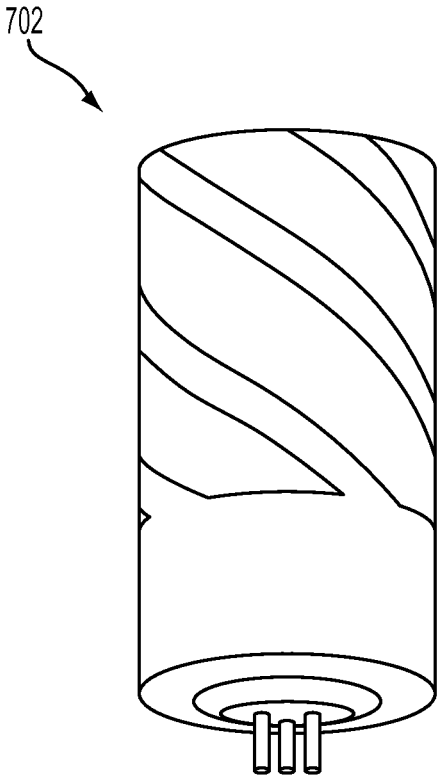
FIG. 8 is a perspective view of the secondary antenna shown in FIG. 7.

A perspective view of antenna 702 is provided in FIG. 8. Although antenna 702 is shown in FIG. 8 to be a dielectrically loaded quadrafilar helix antenna, embodiments of the present invention are not limited in this regard. For example, the antenna 702 can alternatively include a helical antenna, and/or a monopole antenna. The antenna 702 can be a GPS antenna or a GNSS antenna designed for relatively high frequencies. In some embodiments, the antenna 702 is designed for frequencies greater than one gigahertz. For example, the antenna 702 can comprise a dielectric loaded geohelix GPS antenna available from SARANTEL® USA, Inc. of New York. Embodiments of the present invention are not limited in this regard.

Figure 9:
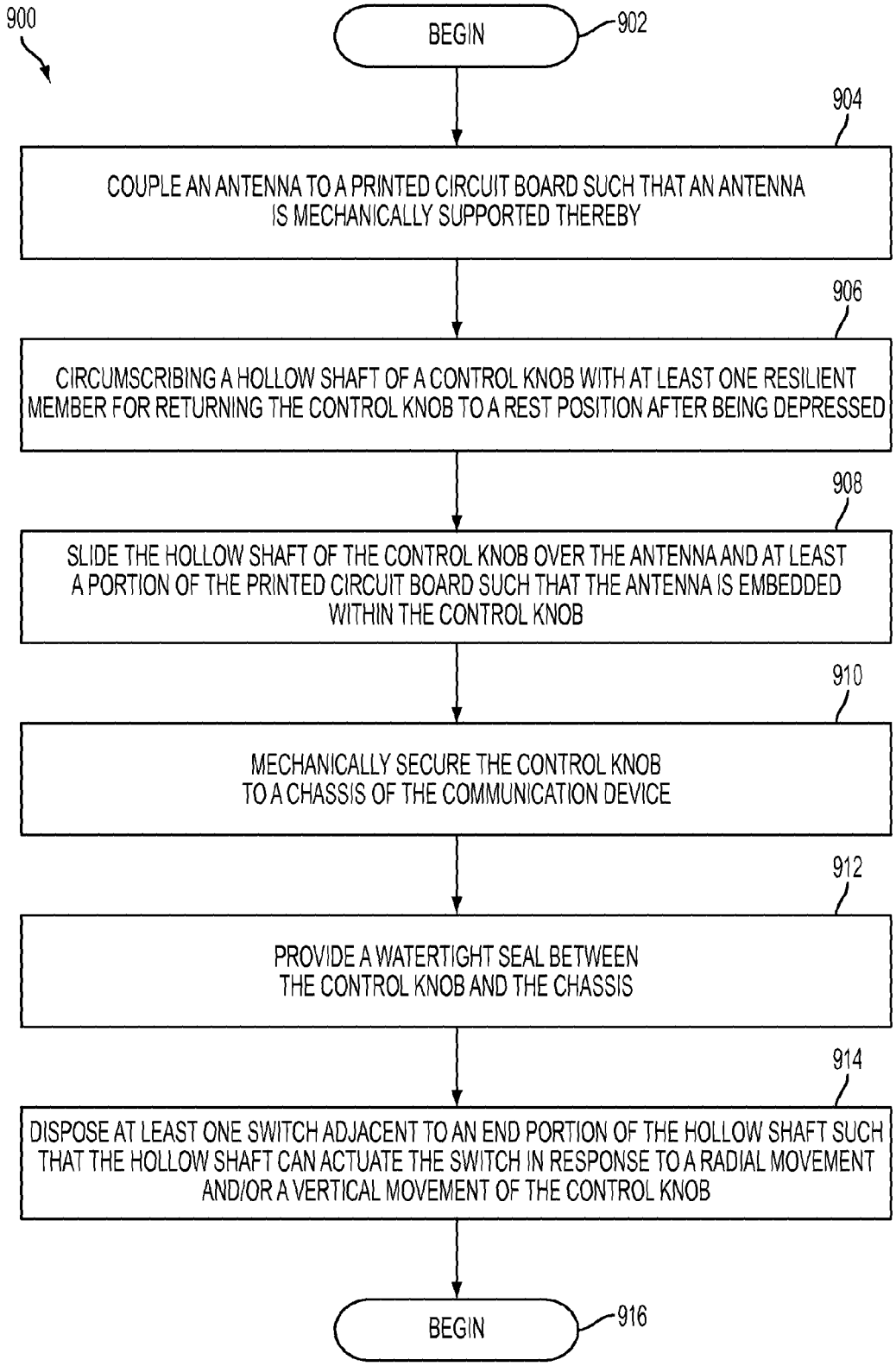
FIG. 9 is a flow diagram of an exemplary method for packaging an antenna in a communications device.

Referring now to FIG. 9, there is provided a flow diagram of an exemplary method 900 for packaging an antenna (e.g., antenna 702 of FIG. 7) in a communications device (e.g., communication device 300 of FIG. 3). The method 900 begins with step 902 and continues with step 904. Step 904 involves coupling the antenna to a PCB (e.g., PCB 706 of FIG. 7) such that the antenna is mechanically supported thereby. In a next step 906, a hollow shaft of a control knob (e.g., control knob 304 of FIG. 3) is circumscribed with at least one resilient member (e.g., spring 608 of FIG. 6) for returning the control knob to a rest position after being depressed. The hollow shaft is then slid over the antenna and at least a portion of the PCB such that the antenna is embedded within the control knob, as shown by step 908. In step 910, the control knob is mechanically secured to a housing (e.g., housing 308 of FIG. 5) of the communication device. The control knob is mechanically secured to the housing; such that it can move in a radial direction and a vertical direction relative to the housing; and such that the hollow shaft is able to move freely over the antenna and PCB without coming in contact therewith. A watertight seal can be provided between the control knob and housing, as shown by step 912. The watertight seal can be created via a gasket (e.g., gasket 504 of FIG. 5). In some embodiments, the gasket is placed on the hollow shaft prior to step 910. At least one switch (e.g., switch $\mathbf{514}_A$, $\mathbf{514}_B$, $\mathbf{514}_C$, $\mathbf{518}_A$ and/or $\mathbf{518}_B$ of FIG. 5) may be disposed adjacent to an end portion of the hollow shaft such that the hollow shaft can actuate the switch in response to a radial movement and/or a vertical movement of the control knob, as shown by step 914. Upon completing step 914, step 916 is performed where the method 900 ends.

All of the apparatus, methods, and algorithms disclosed and claimed herein can be made and executed without undue experimentation in light of the present disclosure. While the invention has been described in terms of preferred embodiments, it will be apparent to those having ordinary skill in the art that variations may be applied to the apparatus, methods and sequence of steps of the method without departing from the concept, spirit and scope of the invention. More specifically, it will be apparent that certain components may be added to, combined with, or substituted for the components described herein while the same or similar results would be achieved. All such similar substitutes and modifications apparent to those having ordinary skill in the art are deemed to be within the spirit, scope and concept of the invention as defined.

We claim:

1. A method for packaging an antenna in a communication device, comprising:

coupling an antenna to an end of an elongate protruding portion of a printed circuit board such that said antenna is mechanically supported thereby, said elongate protruding portion extending out and away from a main body portion of the printed circuit board;

positioning a hollow shaft of a control knob over said antenna and at least a portion of said elongate protruding portion of said printed circuit board such that said antenna and said portion of said elongate protruding portion is embedded within said control knob, where a clearance space exists between said hollow shaft and each of said antenna and said printed circuit board;

disposing a sealing element around a portion of said hollow shaft in which said antenna is disposed in a manner which allows said hollow shaft to rotate freely relative to said sealing element, where the sealing element is provided to create a watertight seal between the hollow shaft and a housing of said communication device;

at least partially locating said hollow shaft and said sealing element in an aperture formed through an outwardly protruding sidewall member of said housing;

resiliently capturing said hollow shaft within said aperture;

mechanically coupling said sealing element to said housing such that said sealing element cannot move relative to said aperture when said control knob is being rotated or depressed; and mechanically securing a control knob cap to said hollow shaft such that at least a portion of each of said antenna, said sealing element and said outwardly protruding sidewall member of said housing is disposed therein.

2. The method according to claim 1, wherein said control knob is mechanically secured to said housing such that it can move in a radial direction and a vertical direction relative to said housing.

3. The method according to claim 1, wherein said antenna is mechanically supported by said printed circuit board such that said hollow shaft is able to move freely thereover without coming in contact therewith.

4. The method according to claim 1, further comprising circumscribing said hollow shaft with a resilient member for returning said control knob to a rest position after being depressed.

5. The method according to claim 1, further comprising disposing a switch adjacent to an end portion of said hollow shaft such that said hollow shaft can actuate said switch in response to a radial movement or a vertical movement of said control knob.

6. A control knob assembly, comprising:

a printed circuit board comprising a main body portion and an elongate protruding portion extending out and away from the main body portion;

an antenna coupled to an end of said elongate protruding portion of said printed circuit board such that said antenna is mechanically supported thereby;

a hollow shaft disposed over said antenna and at least a portion of said elongate protruding portion of said printed circuit board such that said antenna and said portion of said elongate protruding portion of said printed circuit board is embedded within said control knob assembly, where a clearance space exists between said hollow shaft and each of said antenna and said printed circuit board; and a sealing element disposed around a portion of said hollow shaft in which said antenna is disposed in a manner which allows said hollow shaft to rotate freely relative to said sealing element, where the sealing element is provided to create a watertight seal between the hollow shaft and a housing of a controlled device.

7. The control knob assembly of claim 6, further comprising a support structure to which said control knob and said printed circuit board are mechanically secured.

8. The control knob assembly of claim 7, wherein said control knob is mechanically secured to said support structure such that it can move in a radial direction and a vertical direction relative to said support structure.

9. The control knob assembly of claim 7, wherein the sealing element comprises a gasket circumscribing said hollow shaft.

10. The control knob assembly of claim 6, wherein said antenna is mechanically supported by said printed circuit board such that said hollow shaft is able to move freely thereover without coming in contact therewith.

11. The control knob assembly of claim 6, further comprising a resilient member circumscribing said hollow shaft for returning said control knob assembly to a rest position after being depressed.

12. The control knob assembly of claim 6, further comprising a switch disposed adjacent to an end portion of said hollow shaft such that said hollow shaft can actuate said switch in response to a radial movement or a vertical movement of said control knob assembly.

13. A communication device, comprising:

a housing;

a printed circuit board coupled to said housing and comprising a main body portion and an elongate protruding portion extending out and away from the main body portion;

an antenna mechanically coupled to an end of said elongate protruding portion of said printed circuit board such that said antenna is mechanically supported by said printed circuit board; and a control knob assembly having a hollow shaft disposed over said antenna and at least a portion of said elongate protruding portion of said printed circuit board such that said antenna and said portion of said elongate protruding portion of said printed circuit board is embedded within said control knob assembly, where a clearance space exists between said hollow shaft and each of said antenna and said printed circuit board, a sealing element disposed around a portion of said hollow shaft in which said antenna is disposed in a manner which allows said hollow shaft to rotate freely relative to said sealing element, where the sealing element is provided to create a watertight seal between the hollow shaft and a housing of the communication device, and a cap mechanically secured to said hollow shaft such that at least a portion of each of said antenna, said sealing element and said outwardly protruding sidewall member of said housing is disposed therein;

wherein said hollow shaft and said sealing element are at least partially located in an aperture formed through an outwardly protruding sidewall member of said housing, said hollow shaft is resiliently captured within said aperture, and said sealing element is coupled to said housing such that said sealing element cannot move relative to said aperture when said control knob is being rotated or depressed.

14. The communication device of claim 13, wherein said control knob assembly is mechanically coupled to said housing such that it can move in a radial direction and a vertical direction relative to said support structure.

15. The communication device of claim 13, wherein said sealing element comprises a gasket circumscribing said hollow shaft.

16. The communication device of claim 13, wherein said antenna is mechanically supported by said printed circuit board such that said hollow shaft is able to move freely thereover without coming in contact therewith.

17. The communication device of claim 13, further comprising a resilient member circumscribing said hollow shaft for returning said control knob assembly to a rest position after being depressed.

18. The communication device of claim 13, further comprising a switch disposed adjacent to an end portion of said hollow shaft such that said hollow shaft can actuate said switch in response to a radial movement or a vertical movement of said control knob assembly.

19. A communication device, comprising:

a housing containing at least one of a radio transmitter and a radio receiver;

a control knob disposed on an exterior of said housing and configured to control at least one function of said communication device in response to at least one of a rotation movement and an axial movement of said control knob, said control knob comprising a hollow shaft, a sealing element disposed around a portion of said hollow shaft in a manner which allows said hollow shaft to rotate freely relative to said sealing element, where said sealing element is provided to create a watertight seal between the hollow shaft and a housing of said communication device, and a cap mechanically secured to said hollow shaft such that at least a portion of each of an antenna, said sealing element and said housing is disposed therein;

said antenna disposed within said control knob and coupled to at least one of said radio transmitter and said radio receiver;

wherein said hollow shaft and said sealing element are at least partially located in an aperture formed through said housing, said hollow shaft is resiliently captured within said aperture, and said sealing element is coupled to said housing such that said sealing element cannot move relative to said aperture when said control knob is being rotated or depressed.

20. The communication device according to claim 19, wherein said control knob is coupled to at least one control shaft.

21. The communication device according to claim 20, wherein said control knob is configured to cause said control shaft to actuate at least one electronic component of said communication device in response to at least one of said rotation movement and said axial movement.

22. The communication device according to claim 21, wherein said electronic component is a switch.

23. The communication device according to claim 19, wherein said antenna is coupled to a GPS receiver.

* * * * *